US009194565B2

(12) United States Patent
Chen et al.

(10) Patent No.: US 9,194,565 B2
(45) Date of Patent: Nov. 24, 2015

(54) ILLUMINATING DEVICE

(71) Applicant: OSRAM GmbH, Munich (DE)

(72) Inventors: Xiaoyu Chen, Shenzhen Guangdong (CN); Jin Hu, Shenzhen Guangdong (CN); Junhua Zeng, Shenzhen Guangdong (CN); Dirk Buchhauser, Shenzhen Guangdong (CN)

(73) Assignee: Osram GmbH, Munich (DE)

( * ) Notice: Subject to any disclaimer, the term of this patent is extended or adjusted under 35 U.S.C. 154(b) by 0 days.

(21) Appl. No.: 14/372,755

(22) PCT Filed: Jan. 15, 2013

(86) PCT No.: PCT/EP2013/050656

§ 371 (c)(1),
(2) Date: Jul. 17, 2014

(87) PCT Pub. No.: WO2013/107734

PCT Pub. Date: Jul. 25, 2013

(65) Prior Publication Data

US 2015/0003072 A1 Jan. 1, 2015

(30) Foreign Application Priority Data

Jan. 18, 2012 (CN) ..... 2012 1 0016850

(51) Int. Cl.
*F21V 15/00* (2015.01)
*F21V 17/16* (2006.01)
(Continued)

(52) U.S. Cl.
CPC . *F21V 17/16* (2013.01); *F21K 9/13* (2013.01); *F21K 9/137* (2013.01); *F21V 15/01* (2013.01);
(Continued)

(58) Field of Classification Search
CPC ..... F21S 48/1154; F21V 15/01; F21K 9/50
USPC ..... 362/520, 616, 294
See application file for complete search history.

(56) References Cited

U.S. PATENT DOCUMENTS

2006/0227558 A1 10/2006 Osawa et al.
2009/0237943 A1* 9/2009 Schmidt et al. ..... 362/311.02
(Continued)

FOREIGN PATENT DOCUMENTS

CN 102032533 A 4/2011
DE 202009017728 U1 5/2010
EP 2339230 A2 6/2011

OTHER PUBLICATIONS

International Search Report issued in the corresponding PCT application No. PCT/EP2013/050656, dated Apr. 17, 2013.

*Primary Examiner* — Evan Dzierzynski

(57) ABSTRACT

An illuminating device includes a housing, a light-emitting assembly and a driver, wherein the housing includes a first and second cavity and a partition plate, wherein an open end in the first and second cavity may accommodate the light-emitting assembly and the driver, respectively. A lens and a driver housing further respectively mounted thereon wherein the lens and driver housing includes a first supporting leg and a second supporting leg, respectively. The second supporting leg is engaged with a first stop portion formed on an inner wall of the housing, wherein the first supporting leg extends in a through hole in the partition plate to move between a first and a second position deviating circumferentially from the first position, the first supporting leg is locked at the first position between the partition plate and a second stop portion formed in an inner wall of the housing.

11 Claims, 7 Drawing Sheets

(51) Int. Cl.

| | |
|---|---|
| ***F21V 17/14*** | (2006.01) |
| ***F21K 99/00*** | (2010.01) |
| ***F21V 15/01*** | (2006.01) |
| ***F21V 23/00*** | (2015.01) |
| ***F21V 29/507*** | (2015.01) |
| *F21Y 101/02* | (2006.01) |
| *F21Y 105/00* | (2006.01) |

(52) U.S. Cl.
CPC ..... *F21V 17/14* (2013.01); *F21V 17/164* (2013.01); *F21V 23/008* (2013.01); *F21V 29/507* (2013.01); *F21Y 2101/02* (2013.01); *F21Y 2105/001* (2013.01)

(56) References Cited

U.S. PATENT DOCUMENTS

| | | | | |
|---|---|---|---|---|
| 2010/0164348 | A1 | 7/2010 | Huang et al. | |
| 2011/0095690 | A1* | 4/2011 | Sagal | 315/113 |
| 2011/0134634 | A1 | 6/2011 | Gingrich, III et al. | |
| 2011/0141728 | A1* | 6/2011 | Russello et al. | 362/235 |
| 2012/0098408 | A1 | 4/2012 | Gong et al. | |

* cited by examiner

ILLUMINATING DEVICE

RELATED APPLICATIONS

The present application is a national stage entry according to 35 U.S.C. §371 of PCT application No.: PCT/EP2013/050656 filed on Jan. 15, 2013, which claims priority from Chinese application No.: 201210016850.1 filed on Jan. 18, 2012, and is incorporated herein by reference in its entirety.

TECHNICAL FIELD

Various embodiments relate to an illuminating device.

BACKGROUND

As is known to all, LED illumination has irreplaceable advantages. It is energy saving, has very low power consumption, has a nearly 100% electro-optical power conversion, can save more than 80% of energy with the same illumination efficiency compared with the traditional light source, and has a long lifespan. In view of the above advantages, people more and more frequently use LEDs as light sources, for example, numerous LED retrofit lamps in the market. Such LED retrofit lamps have a profile of a traditional light source such as an incandescent lamp or lamp tube, such that they, as light sources, can be adapted to the existing illumination systems.

The related art discloses an LED retrofit lamp which includes: a driver housing for accommodating a driver; a heat sink fixed on the driver housing through an end of thereof, wherein the other end of the heat sink is in thermal conduct with a printed circuit board carrying an LED chip. In addition, in order to achieve the predetermined optical effects, the LED retrofit lamp usually further includes an additional optical component, such as a lens. The lens needs to be fixed on an inner wall of a light emergent opening defined by the heat sink. In the prior art, in order to fix the driver housing and the lens on the heat sink, the method of fastening bolt, glue, or snap-fit connection is usually employed. However, fixing the lens on the heat sink by a fastening bolt will inevitably affect the optical effects of the lens. This is because the lens must be drilled for the fastening bolt to go through. When the glue is used for connection, in the case where an electronic device in the LED retrofit lamp is out of work and needs to be changed, the glue cannot be removed to disassemble the leans or the driver housing. When the snap-fit connection is employed, as a hook which may be provided is within the heat sink and is out of reach, the methods using violence can only be used when it is necessary to disassemble the LED retrofit lamp, which will inevitably damage the driver housing or the lens.

SUMMARY

In order to solve the above technical problems, various embodiments provide an illuminating device which can be assembled simply and can be easily disassembled when a failure occurs.

Various embodiments provide an illuminating device, viz. the illuminating device including: a housing; a light-emitting assembly and a driver, wherein the housing includes a first cavity and a second cavity partitioned by a partition plate, wherein the first cavity has one end open and is configured to accommodate the light-emitting assembly, and the second cavity has one end open and is configured to accommodate the driver; a lens assembly mounted on the open end of the first cavity; and a driver housing mounted on the open end of the second cavity, wherein the lens assembly includes at least one first supporting leg, and the driver housing includes at least one second supporting leg, the second supporting leg is engaged with a first stop portion formed on an inner wall of the housing, wherein the first supporting leg is capable of going through a through hole in the partition plate to move between a first position and a second position deviating from the first position in a circumferential direction, the first supporting leg is locked at the first position between the partition plate and a second stop portion formed in an inner wall of the housing which defines the second cavity, and withdraws from the second stop portion at the second position, so as to be capable of pushing the second supporting leg in a longitudinal direction to withdraw from the first stop portion. In the design solution of the present disclosure, by simply rotating the lens assembly in a circumferential direction, the lens assembly can enter the locking position or withdraw from the locking position. After the lens assembly withdraws from the locking position, the driver housing can be disconnected from the housing of the illuminating device by simply pressing the lens assembly in a longitudinal direction. Thus, at the time of disassembling the illuminating device, it is not necessary to destroy the components of the illuminating device, and the disassembly and assembly are relatively simple.

According to various embodiments, the first supporting leg includes a base portion and a locking portion formed at one side of the base portion, wherein the locking portion includes a body portion that has a free end surface forming a lower stop surface interacting with the second stop portion, the locking portion further includes a stop block protruding from the body portion, an upper end surface of the stop block forms an upper stop surface pressing against the partition plate, wherein a distance between the free end surface of the body portion and the partition plate is shorter than a distance between a free end surface of the base portion and the partition plate by a predetermined distance. In various embodiments, the locking portion formed on the first supporting leg can ensure that the first supporting leg is engaged with the housing, without using any additional fastening component. The lens assembly can be prevented from further moving from the first position towards the housing in a longitudinal direction, by means of the lower stop portion on the body portion of the locking portion. The upper stop surface formed on the stop block can prevent the lens assembly from escaping from the housing in a longitudinal direction at the first position. Further, by simply rotating the lens assembly in a circumferential direction, the lens assembly can be locked on the housing or unlocked from the housing.

Preferably, a first accommodation groove is formed on the inner wall of the housing which defines the second cavity, the first accommodation groove accommodates the base portion of the first supporting leg at the first position, and accommodates the base portion and the locking portion of the first supporting leg at the second position, wherein a lower end surface of the first accommodation groove forms the first stop portion for the second supporting leg. The first accommodation groove is provided right below the through hole, and in order to ensure the movement of the first supporting leg between the first position and the second position, the size of the first accommodation groove must be designed as large as possible, such that the first accommodation groove can at least accommodate the entire first supporting leg at the second position.

Further preferably, a second accommodation groove at one side of the first accommodation groove is further formed on the inner wall of the housing which defines the second cavity, wherein the second accommodation groove accommodates the locking portion of the first supporting leg at the first position, and wherein a lower end surface of the second accommodation groove forms the second stop portion for the first supporting leg. The second accommodation groove defines the accommodation space of the locking portion of the first supporting leg, so as to avoid the undesired movement of the first supporting leg in the housing.

According to the various embodiments, the lower end surface of the first accommodation groove is apart from the partition plate at a first distance, the lower end surface of the second accommodation groove is apart from the partition plate at a second distance, wherein the second distance is smaller than the first distance by the predetermined distance. In various embodiments, the size of the locking portion of the first supporting leg matches with the size of the first accommodation groove, so as to ensure that the lens assembly can be stably fixed on the housing at the first position, without shaking.

Further preferably, a guide groove which is below the first accommodation groove and is used for the second supporting leg is formed on the inner wall of the housing, wherein the lower end surface of the first accommodation groove forms transition steps between the guide groove and the first accommodation groove. The guide groove can have a guiding function for the second supporting leg, which facilitates assembly and disassembly. The transition steps actually form locking parts for the second supporting leg.

According to various embodiments, a circumferential stop groove is further formed on the free end surface of the body portion, a circumferential stop protrusion is formed on the lower end surface of the second accommodation groove, and at the first position, the circumferential stop protrusion is engaged with the circumferential stop groove. In this way, the occurrence of undesired movement of the lens assembly in a circumferential direction can be simply avoided.

Preferably, the circumferential stop groove is defined by an L-shaped end surface recessed from the lower stop surface.

Optionally, the lens assembly further includes a base board mounted with a plurality of lenses, the first supporting leg extends from a circumferential edge of the base board in a direction away from the base board, wherein a connection portion between the base board and the first supporting leg is formed with a tool slot extending in a longitudinal direction of the first supporting leg. At the time of assembly and disassembly, a tool can be inserted into the tool slot, which makes assembly and disassembly easy.

According to various embodiments, a hook is formed at a free end of the second supporting leg, wherein an inclined surface interacting with the base portion of the first supporting leg is formed at a top portion of the hook. In order to disassemble the illuminating device of the present disclosure, the first supporting leg can be used to disengage the second supporting leg from the first stop portion. For this, when the lens assembly is at the second position, pressure can be applied to the lens assembly in a longitudinal direction, to make the lens assembly move in longitudinal direction, viz. in a direction towards the interior of the housing, such that the base portion of the first supporting leg presses against the inclined surface of the snapper, to force the snapper to be lifted from the first stop portion, so as to eliminate the snap-fit connection of the hook.

Preferably, in various embodiments, the housing of the illuminating device is configured as a heat dissipating device.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the disclosed embodiments. In the following description, various embodiments described with reference to the following drawings, in which.

DETAILED DESCRIPTION

The following detailed description refers to the accompanying drawing that show, by way of illustration, specific details and embodiments in which the disclosure may be practiced.

Figure 1:
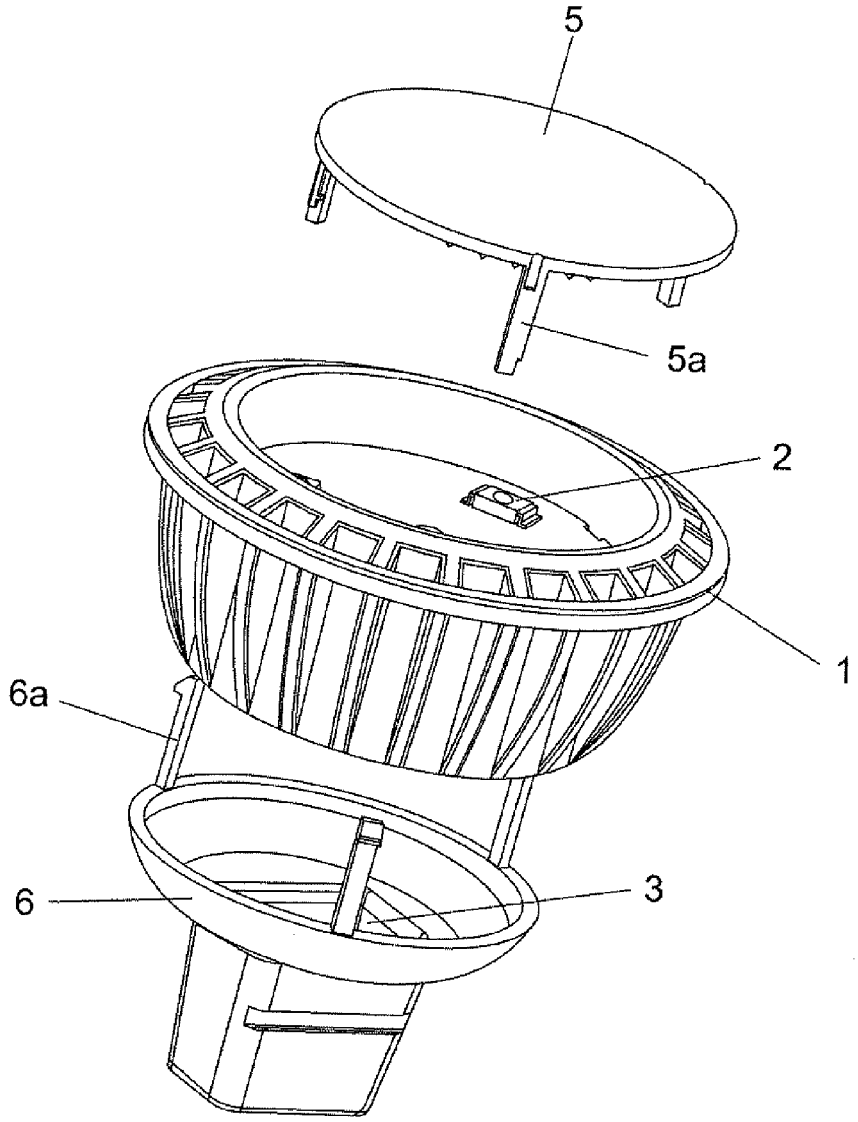
FIG. 1 is an exploded perspective view of the illuminating device according to the present disclosure.

FIG. 1 is an exploded perspective view of the illuminating device according to the present disclosure. As can be seen from the figure, the illuminating device according to the present disclosure comprises: a housing 1 configured as a heat dissipating device; a light-emitting assembly 2 and a driver 3; a lens assembly 5; and a driver housing 6. As can be seen from the figure, the lens assembly 5 comprises three first supporting legs 5*a*, and the driver housing 6 comprises three second supporting legs 6*a*. Of course, the number of the supporting legs is not limited to three, it can be other numbers, such as four, five, six or ten etc.

Figure 2:
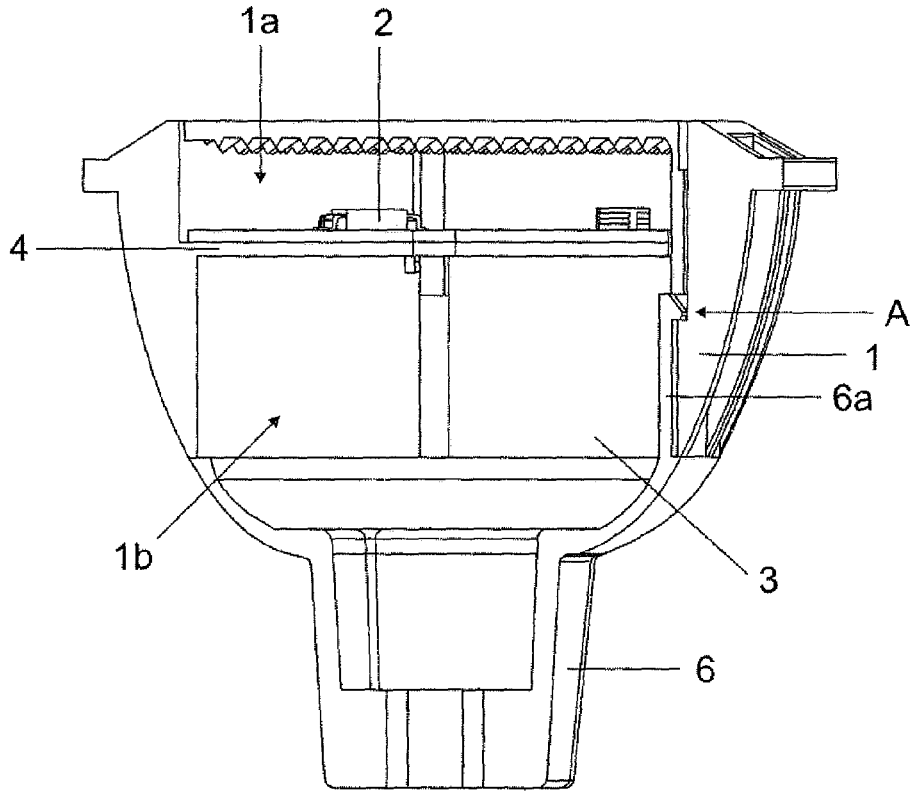
FIG. 2 is a sectional view of the illuminating device according to the present disclosure.

FIG. 2 is a sectional view of the illuminating device according to the present disclosure. As can be seen from the figure, the housing 1 comprises a first cavity 1*a* and a second cavity 1*b* partitioned by a partition plate 4, wherein the first cavity 1*a* has one end open and is configured to accommodate the light-emitting assembly 2, and the second cavity 1*b* has one end open and is configured to accommodate the driver 3. The lens assembly 5 is mounted on the open end of the first cavity 1*a*; and the driver housing 6 mounted on the open end of the second cavity 1*b*. As can be further seen from the figure, the second supporting leg 6*a* of the driver housing 6 is engaged with a first stop portion A formed on an inner wall of the housing 1.

Figure 3:
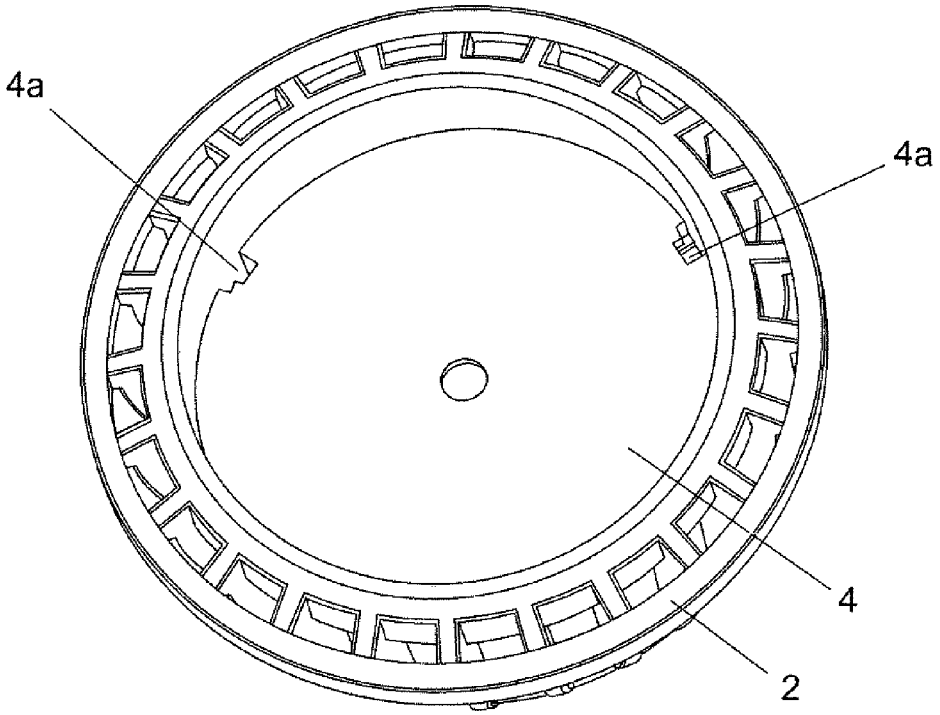
FIG. 3 is a top view of the inner structure of the housing of the illuminating device according to the present disclosure.

FIG. 3 is a top view of the inner structure of the housing of the illuminating device according to the present disclosure. As can be seen from the figure, three through holes 4*a*, the positions of which are corresponding to the positions of the first supporting legs 5*a* of the lens assembly 5, are formed on the partition plate 4. The first supporting legs 5*a* is capable of going through the through holes 4*a* to move between a first position and a second position deviating from the first position in a circumferential direction, wherein the first supporting leg 5*a* is locked at the first position between the partition plate 4 and a second stop portion B formed in an inner wall of the housing 1 which defines the second cavity 1*b*, and withdraws from the second stop portion B at the second position, so as to be capable of pushing the second supporting leg 6*a* in a longitudinal direction to withdraw from the first stop portion A.

Figure 4:
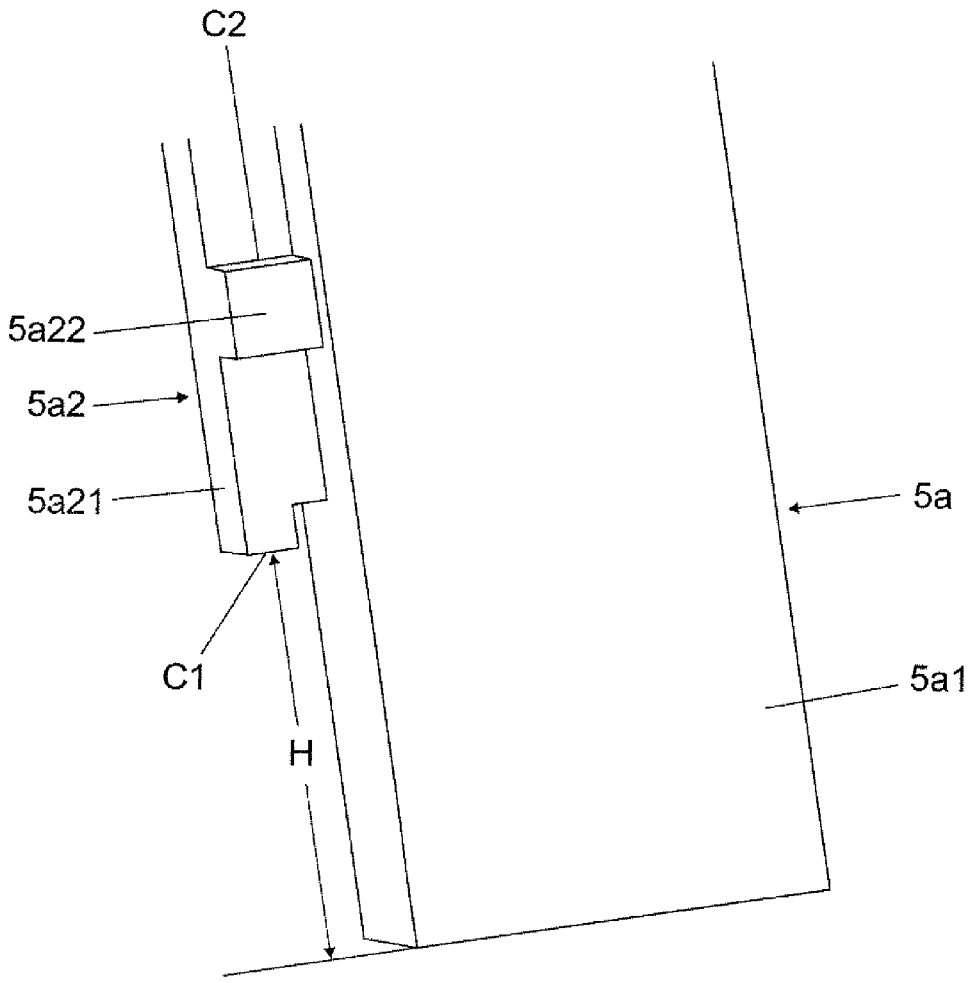
FIG. 4 is a local schematic diagram of the first supporting leg of the lens assembly of the illuminating device according to the present disclosure.

FIG. 4 is a local schematic diagram of the first supporting leg 5*a* of the lens assembly 5 of the illuminating device according to the present disclosure. As can be seen from the figure, the first supporting leg 5*a* comprises a base portion 5*a*1 and a locking portion 5*a*2 formed at one side of the base portion 5*a*1, wherein the locking portion 5*a*2 comprises a body portion 5*a*21 that has a free end surface forming a lower stop surface C1 interacting with the second stop portion B, the locking portion 5*a*2 further comprises a stop block 5*a*22 protruding from the body portion 5*a*21. An upper end surface of the stop block 5*a*22 forms an upper stop surface C2 pressing against the partition plate 4. A distance between the free end surface of the body portion 5*a*21 and the partition plate 4 is shorter than a distance between a free end surface of the base portion 5*a*1 and the partition plate 4 by a predetermined distance H.

Figure 5:
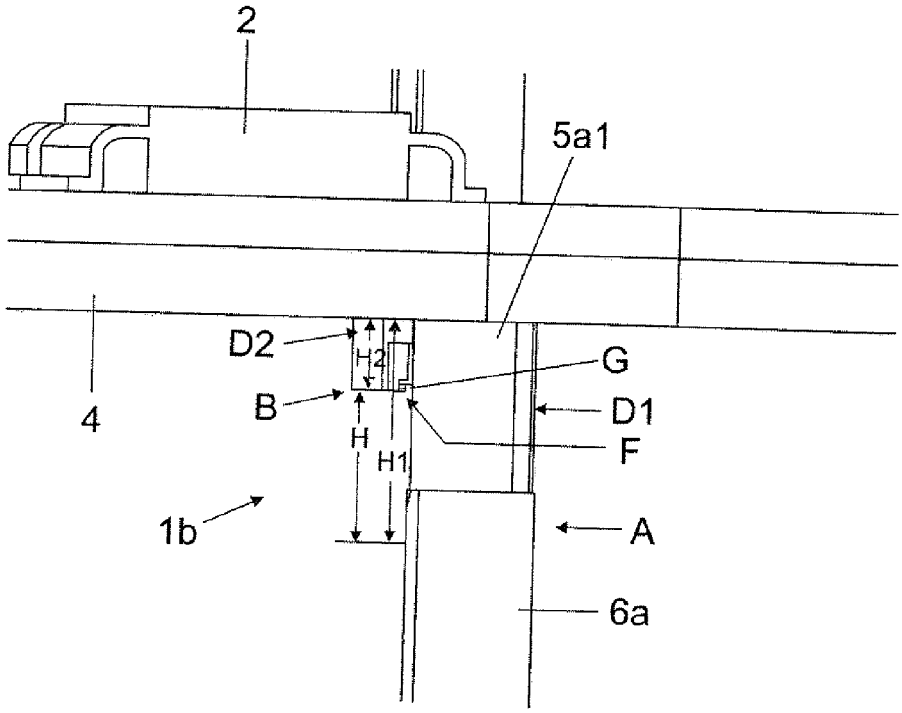
FIG. 5 is a schematic diagram of the inner structure of the housing of the illuminating device according to the present disclosure.

FIG. 5 is a schematic diagram of the inner structure of the housing of the illuminating device according to the present disclosure. As can be seen from the figure, a first accommodation groove D1 is formed on the inner wall of the housing 1 which defines the second cavity 1*b*, the first accommodation groove D1 accommodates the base portion 5*a*1 of the first supporting leg 5*a* at the first position, and accommodates the base portion 5*a*1 and the locking portion 5*a*2 of the first supporting leg 5*a* at the second position. In the schematic diagram, the first supporting leg 5*a* is at the first position, and thus, the base portion 5*a*1 is accommodated in the first accommodation groove D1, and the locking portion 5*a*2 is accommodated in the second accommodation groove D2. In addition, as can be seen from the figure, a lower end surface of the first accommodation groove D1 forms the first stop portion A for the second supporting leg 6*a*.

As can be further seen from FIG. 5, the second accommodation groove D2 at one side of the first accommodation groove D1 is further formed on the inner wall of the housing 1 which defines the second cavity 1*b*, wherein the second accommodation groove D2 accommodates the locking portion 5*a*2 of the first supporting leg 5*a* at the first position, and wherein a lower end surface of the second accommodation groove D2 forms the second stop portion B for the first supporting leg 5*a*. In addition, a circumferential stop groove F is further formed on the free end surface of the body portion 5*a*21, a circumferential stop protrusion G is formed on the lower end surface of the second accommodation groove D2, and at the first position, the circumferential stop protrusion G is engaged with the circumferential stop groove F. In the design solution of the present disclosure, the circumferential stop groove F is defined by an L-shaped end surface recessed from the lower stop surface C1.

Figure 6:
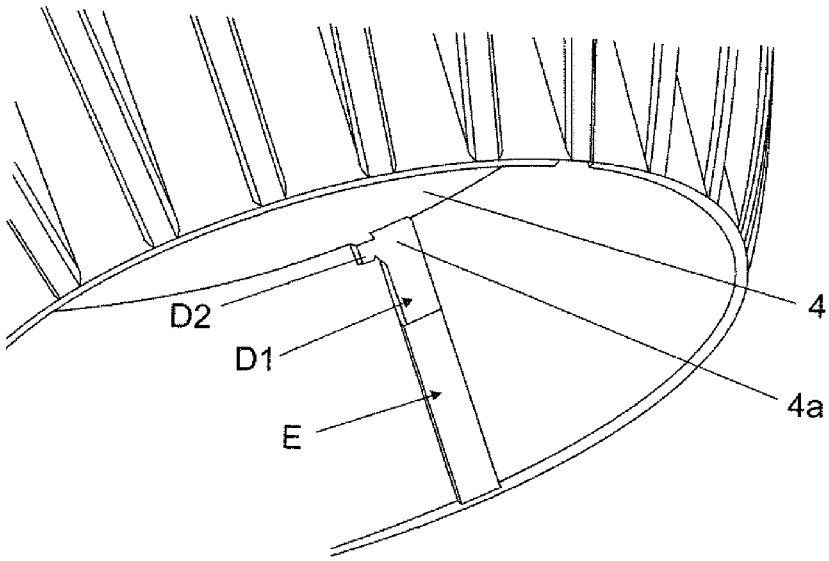
FIG. 6 is a local schematic diagram of the housing of the illuminating device according to the present disclosure.

FIG. 6 is a local schematic diagram of the housing of the illuminating device according to the present disclosure. As can be seen from the figure, a guide groove E which is below the first accommodation groove D1 and is used for the second supporting leg 6*a* is formed on the inner wall of the housing 1, wherein the lower end surface of the first accommodation groove D1 forms transition steps between the guide groove E and the first accommodation groove D1. In addition, as can be further seen from the figure, the lower end surface of the first accommodation groove D1 is apart from the partition plate 4 at a first distance H1, the lower end surface of the second accommodation groove D2 is apart from the partition plate 4 at a second distance H2, wherein the second distance H2 is smaller than the first distance H1 by the predetermined distance H.

Figure 7:
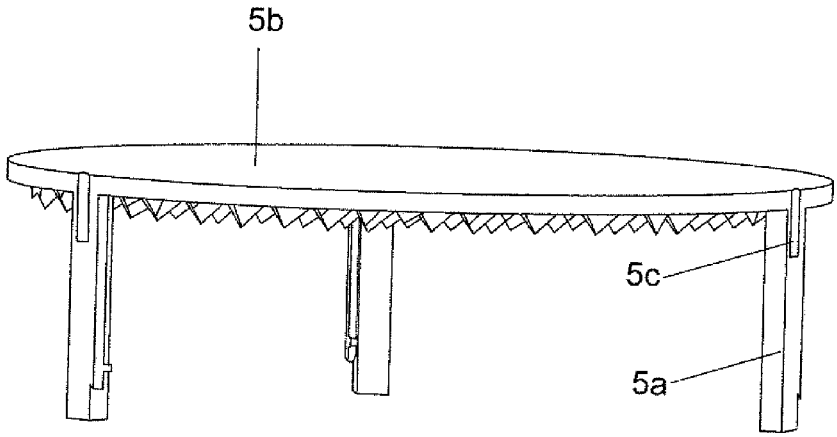
FIG. 7 is a schematic diagram of the lens assembly of the illuminating device according to the present disclosure.

FIG. 7 is a schematic diagram of the lens assembly of the illuminating device according to the present disclosure. As can be seen from the figure, the lens assembly 5 further comprises a base board 5*b* mounted with a plurality of lenses. The first supporting leg 5*a* extends from a circumferential edge of the base board 5*b* in a direction away from the base board 5*b*, wherein a connection portion between the base board 5*b* and the first supporting leg 5*a* is formed with a tool slot 5*c* extending in a longitudinal direction of the first supporting leg 5*a*. A tool for assembling and disassembling the lens assembly can be inserted into the tool slot 5*c*.

Figure 8:
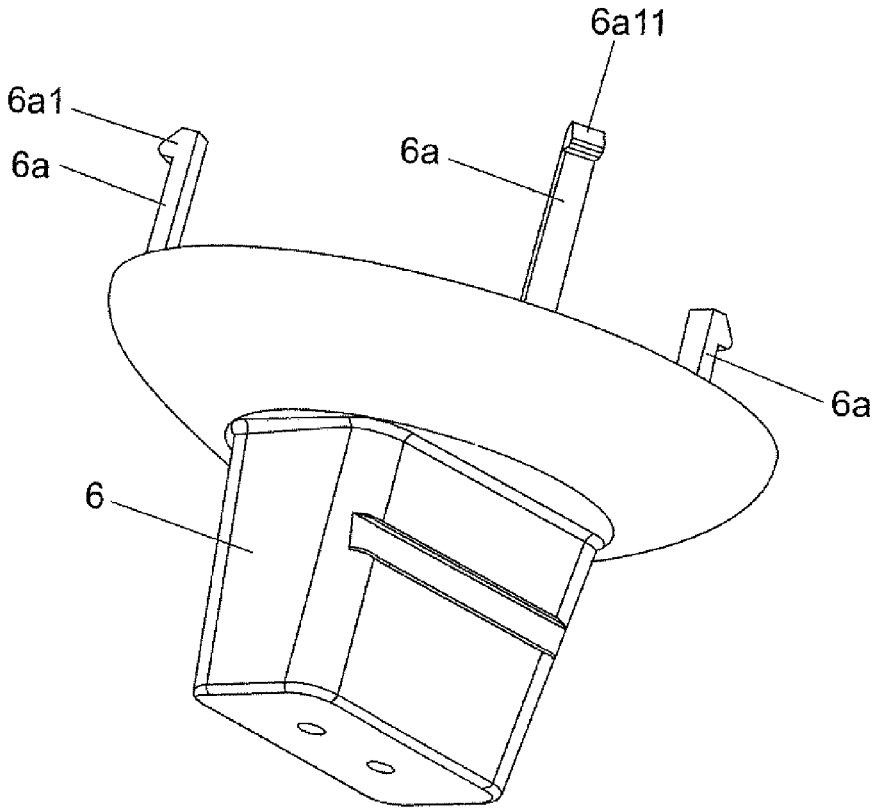
FIG. 8 is a schematic diagram of the driver housing of the illuminating device according to the present disclosure.

FIG. 8 is a schematic diagram of the driver housing of the illuminating device according to the present disclosure. As can be seen from the figure, three second supporting legs 6*a* are provided on the driver housing 6. A hook 6*a*1 is formed at a free end of the second supporting leg 6*a*, wherein an inclined surface 6*a*11 interacting with the base portion 5*a*1 of the first supporting leg 5*a* is formed at a top portion of the hook 6*a*1. As can be seen in conjunction with FIG. 5, after the first supporting leg 5*a* and the second supporting leg 6*a* are inserted into the housing 1, the first supporting leg 5*a* is firstly at the second position, the lens assembly 5 is rotated, and then the first supporting leg 5*a* goes to the first position, and the locking portion 5*a*2 of the first supporting leg 5*a* goes into the second accommodation groove D2, so as to fix the first supporting leg 5*a* at the first position, which prevents the lens assembly 5 from escaping from the housing 1 or from further moving towards the housing 1. At this time, the hook 6*a*1 of the second supporting leg 6*a* is just engaged with the first stop portion A, which prevents the driver housing 6 from escaping from the housing.

In order to disassemble the driver housing 6 and the lens assembly 5, the lens assembly 5 is firstly rotated such that it goes from the first position to the second position, at the second position, the entire first supporting leg 5*a* of the lens assembly 5 is accommodated in the first accommodation groove D1, in this way, the first supporting leg 5*a* can move in the longitudinal direction. The free end of the first supporting leg 5*a* presses against the inclined surface 6*a*11 of the hook 6*a*1, when the lens assembly is pressed downwards, viz. towards the interior of the housing 1, the free end of the first supporting leg 5*a* presses against the inclined surface ball of the hook 6*a*1, so as to force the hook 6*a*1 to be lifted from the first stop portion A, and thereby, eliminate the engagement between the second supporting leg 6*a* and the housing 1.

While the disclosed embodiments have been particularly shown and described with reference to specific embodiments, it should be understood by those skilled in the art that various changes in form and detail may be made therein without departing from the spirit and scope of the disclosed embodiments as defined by the appended claims. The scope of the disclosed embodiments is thus indicated by the appended claims and all changes which come within the meaning and range of equivalency of the claims are therefore intended to be embraced.

LIST OF REFERENCE SIGNS

1 housing
1*a* first cavity
1*b* second cavity
2 light-emitting assembly
3 driver
4 partition plate
4*a* through hole
5 lens assembly
5*a* first supporting leg

5a1 base portion
5a2 locking portion
5a21 body portion
5a22 stop block
5b base board
5c tool slot
6 driver housing
6a second supporting leg
6a1 hook
6a11 inclined surface
A first stop portion
B second stop portion
C1 lower stop surface
C2 upper stop surface
D1 first accommodation groove
D2 second accommodation groove
E guide groove
F circumferential stop groove
G circumferential stop protrusion
H predetermined distance
H1 first distance
H2 second distance

The invention claimed is:

1. An illuminating device, comprising:

a housing;

a light-emitting assembly and a driver, wherein the housing comprises a first cavity and a second cavity partitioned by a partition plate, wherein the first cavity has one end open and is configured to accommodate the light-emitting assembly, and the second cavity has one end open and is configured to accommodate the driver;

a lens assembly mounted on the open end of the first cavity; and a driver housing mounted on the open end of the second cavity, wherein the lens assembly comprises at least one first supporting leg, and the driver housing comprises at least one second supporting leg, the second supporting leg is engaged with a first stop portion formed on an inner wall of the housing, wherein the first supporting leg is capable of going through a through hole in the partition plate to move between a first position and a second position deviating from the first position in a circumferential direction, the first supporting leg is locked at the first position between the partition plate and a second stop portion formed in an inner wall of the housing which defines the second cavity, and withdraws from the second stop portion at the second position, so as to be capable of pushing the second supporting leg in a longitudinal direction to withdraw from the first stop portion.

2. The illuminating device according to claim 1, wherein the first supporting leg comprises a base portion and a locking portion formed at one side of the base portion, wherein the locking portion comprises a body portion that has a free end surface forming a lower stop surface interacting with the second stop portion, the locking portion further comprises a stop block protruding from the body portion, an upper end surface of the stop block forms an upper stop surface pressing against the partition plate, wherein a distance between the free end surface of the body portion and the partition plate is shorter than a distance between a free end surface of the base portion and the partition plate by a predetermined distance.

3. The illuminating device according to claim 2, where a first accommodation groove is formed on the inner wall of the housing which defines the second cavity, the first accommodation groove accommodates the base portion of the first supporting leg at the first position, and accommodates the base portion and the locking portion of the first supporting leg at the second position, wherein a lower end surface of the first accommodation groove forms the first stop portion for the second supporting leg.

4. The illuminating device according to claim 3, wherein a second accommodation groove at one side of the first accommodation groove is further formed on the inner wall of the housing which defines the second cavity, wherein the second accommodation groove accommodates the locking portion of the first supporting leg at the first position, and wherein a lower end surface of the second accommodation groove forms the second stop portion for the first supporting leg.

5. The illuminating device according to claim 4, wherein the lower end surface of the first accommodation groove is apart from the partition plate at a first distance, the lower end surface of the second accommodation groove is apart from the partition plate at a second distance, wherein the second distance is smaller than the first distance by the predetermined distance.

6. The illuminating device according to claim 5, wherein a guide groove which is below the first accommodation groove and is used for the second supporting leg is formed on the inner wall of the housing, wherein the lower end surface of the first accommodation groove forms transition steps between the guide groove and the first accommodation groove.

7. The illuminating device according to claim 2, wherein a circumferential stop groove is further formed on the free end surface of the body portion, a circumferential stop protrusion is formed on the lower end surface of the second accommodation groove, and at the first position, the circumferential stop protrusion is engaged with the circumferential stop groove.

8. The illuminating device according to claim 7, wherein the circumferential stop groove is defined by an L-shaped end surface recessed from the lower stop surface.

9. The illuminating device according to claim 2, wherein the lens assembly further comprises a base board mounted with a plurality of lenses, the first supporting leg extends from a circumferential edge of the base board in a direction away from the base board, wherein a connection portion between the base board and the first supporting leg is formed with a tool slot extending in a longitudinal direction of the first supporting leg.

10. The illuminating device according to claim 2, wherein a hook is formed at a free end of the second supporting leg, wherein an inclined surface interacting with the base portion of the first supporting leg is formed at a top portion of the hook.

11. The illuminating device according to claim 1, wherein the housing is configured as a heat dissipating device.

* * * * *